US009032649B1

(12) United States Patent
Villanueva

(10) Patent No.: US 9,032,649 B1
(45) Date of Patent: May 19, 2015

(54) DEFROSTING UNIT FOR SNOW BLOWER

(71) Applicant: Jorge I. Villanueva, Paterson, NJ (US)

(72) Inventor: Jorge I. Villanueva, Paterson, NJ (US)

( * ) Notice: Subject to any disclaimer, the term of this patent is extended or adjusted under 35 U.S.C. 154(b) by 0 days.

(21) Appl. No.: 14/075,386

(22) Filed: Nov. 8, 2013

(51) Int. Cl.
*E01H 5/04* (2006.01)
*E01H 5/08* (2006.01)

(52) U.S. Cl.
CPC . *E01H 5/045* (2013.01); *E01H 5/08* (2013.01)

(58) Field of Classification Search
CPC ..... E01H 5/045; E01H 5/10; E01H 5/102; E01H 55/104; E01H 5/104
USPC ..... 37/199, 200, 226, 227, 248
See application file for complete search history.

(56) References Cited

U.S. PATENT DOCUMENTS 2,237,124 A * 4/1941 Toolan ..... 454/123
2,389,704 A * 11/1945 Villani ..... 454/122
2,492,506 A * 12/1949 Stinnett ..... 454/124
3,248,133 A * 4/1966 Michnoff ..... 285/148.18
3,416,428 A * 12/1968 Heller ..... 454/123
3,447,186 A * 6/1969 Senkewich ..... 15/250.04
3,465,455 A 9/1969 Kiernan
3,596,710 A * 8/1971 Neal ..... 165/41
4,037,336 A * 7/1977 Benson ..... 37/427
4,164,820 A * 8/1979 Krickovich ..... 37/229
5,083,387 A * 1/1992 Tillotson et al. ..... 37/260
5,438,770 A 8/1995 Miller
5,551,384 A * 9/1996 Hollis ..... 123/142.5 R
6,353,212 B1 * 3/2002 Smith ..... 219/533
7,059,071 B2 * 6/2006 Hanafusa et al. ..... 37/249
7,866,067 B2 1/2011 Harmelink
2006/0021592 A1 2/2006 Ryczek et al.

* cited by examiner

*Primary Examiner* — Jamie L McGowan
(74) *Attorney, Agent, or Firm* — Robert C. Montgomery; Montgomery Patent & Design LP

(57) ABSTRACT

A defrost unit can include a throat insert configured to be attached to a snow blower, and an exhaust piping assembly interconnected between the throat insert and an engine exhaust outlet of the snow blower, wherein exhaust gasses from the engine exhaust outlet are directed to the throat insert.

14 Claims, 3 Drawing Sheets

DEFROSTING UNIT FOR SNOW BLOWER

RELATED APPLICATIONS

Not applicable.

FIELD OF THE INVENTION

The present invention relates generally to snow blowers, and more particularly, to defrost unit attached to a snow blower.

BACKGROUND OF THE INVENTION

Those of us who live in areas where the winter climate brings snow, sleet, and ice, know all too well of the hazards associated with getting rid of such hazards. Many people resort to a snow blower to assist in snow removal. Snow blowers are easy to operate, can move massive amounts of snow, and require only minimal physical exertion.

However, snow blowers are not without their disadvantages as well. First, snow blowers can be somewhat noisy, especially when run early in the morning where they can wake up sleeping neighbors. Secondly, the discharge chute on snow blowers is easily clogged by heavy snow and ice. Many users attempt to unclog the snow blower by sticking their hand into the chute. This is a very dangerous decision, and can result in the accidental amputation of fingers and hands.

Accordingly, there exists a need for a means by which snow blowers can be prevented from clogging as well as operate in a quiet manner, in order to address the problems as described above.

SUMMARY OF THE INVENTION

The inventor has recognized the aforementioned inherent problems and lack in the art and observed that there remains a need for an apparatus that provides a means defrosting a thrower and chute of a snow blower. The development of the present invention, which will be described in greater detail herein, substantially departs from conventional solutions to provide a defrost unit and in doing so fulfills this need.

In one (1) embodiment, the disclosed defrost unit can include a throat insert configured to be attached to a snow blower, and an exhaust piping assembly interconnected between the throat insert and an engine exhaust outlet of the snow blower, wherein exhaust gasses from the engine exhaust outlet are directed to the throat insert.

In another embodiment, the disclosed defrost unit can include a snow blower including at least an engine, a thrower outlet, and a chute, a throat insert attached to the snow blower between the thrower outlet and the chute, and an exhaust piping assembly interconnected between the throat insert and an engine exhaust outlet of the engine, wherein exhaust gasses from the engine exhaust outlet are directed to the throat insert.

Furthermore, the described features and advantages of the disclosed defrost unit can be combined in various manners and embodiments as one skilled in the relevant art will recognize after reading the present disclosure. The disclosure can be practiced without one (1) or more of the features and advantages described in any particular embodiment.

Further advantages of the present disclosure will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

DESCRIPTIVE KEY

Figure 1:
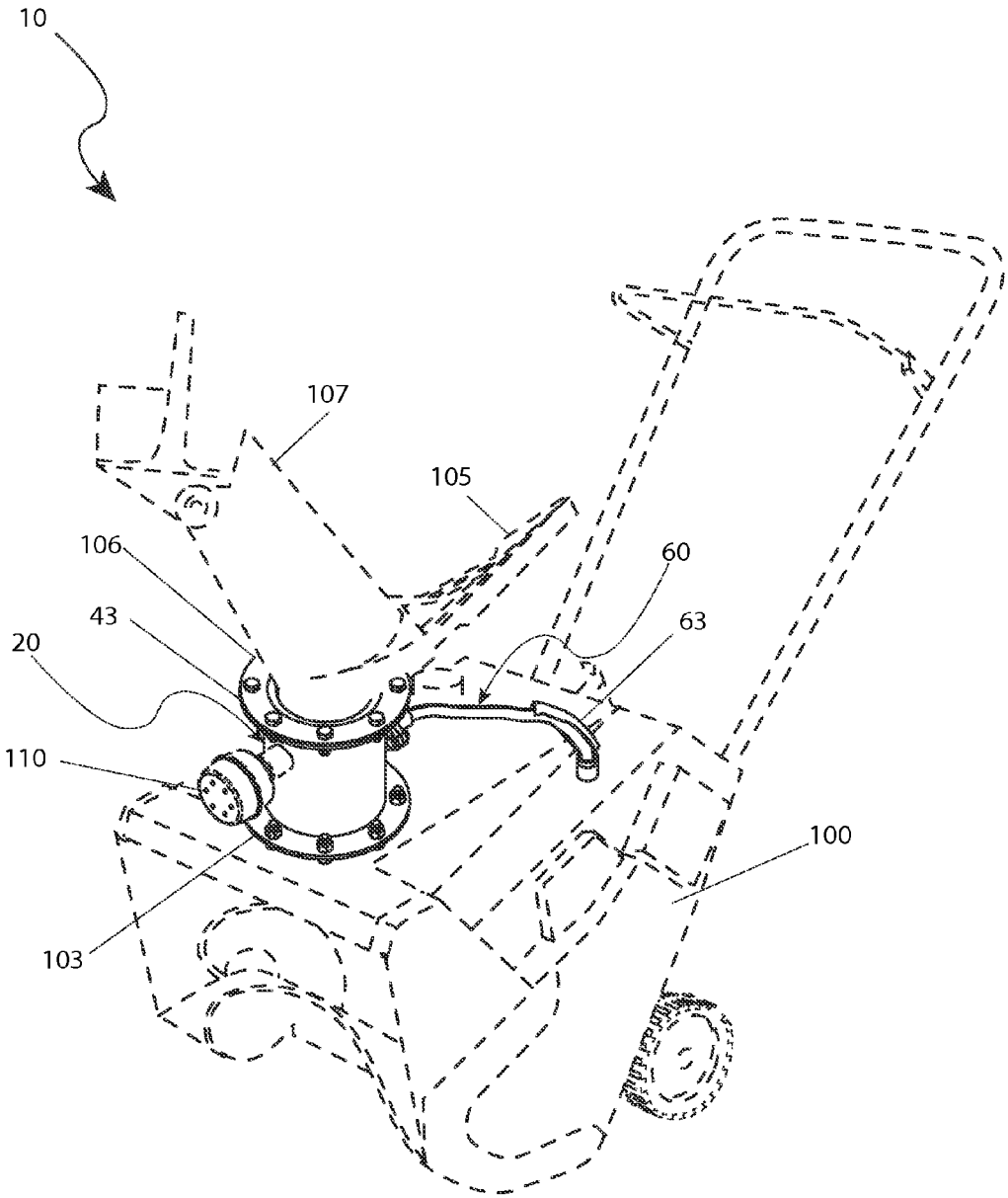
FIG. 1 is a front and side perspective view of one embodiment of the disclosed defrosting unit shown attached to a snow blower in accordance with the present invention.

10 defrosting unit
20 throat insert
22 inner wall
24 outer wall
26 inlet fitting
27 inlet flange
31 outlet fitting
35 lower flange
36 lower flange aperture
38 upper flange
39 upper flange aperture
41 threaded fastener
42 nut
43 flange gasket
44 interior cavity
47 interior passage
50 exhaust piping assembly
52 exhaust fitting
54 exhaust fitting flange
56 flange threaded fastener
57 nut
60 adapter pipe assembly
61 first pipe
62 first pipe flange
63 heat shield
64 standoff leg
65 flexible pipe
67 second pipe
68 second pipe flange
100 snow blower
101 engine
103 thrower outlet flange
105 rotator
106 rotator flange
107 discharge chute
110 muffler

DETAILED DESCRIPTION OF THE PREFERRED EMBODIMENT

Figure 2:
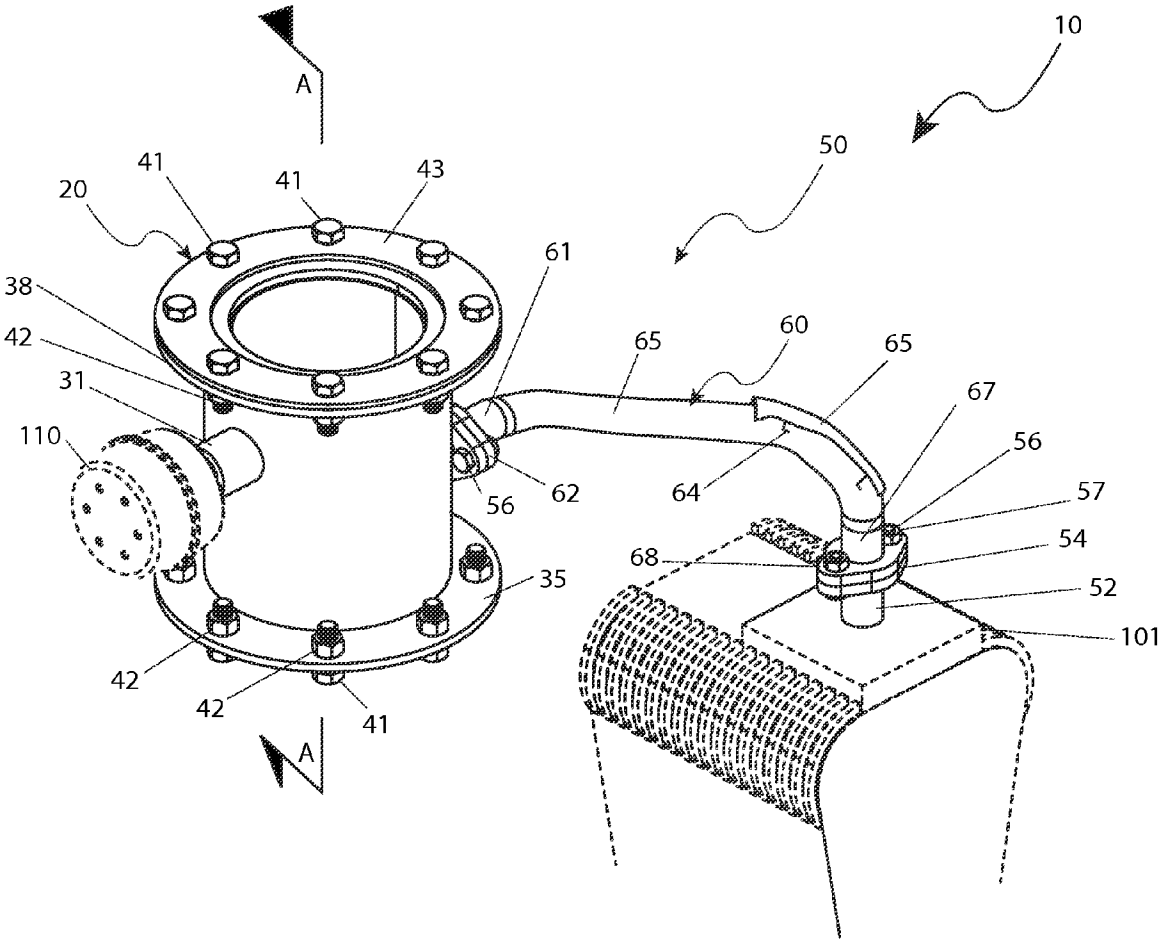
FIG. 2 is an isolated perspective view of the disclosed defrosting unit of FIG. 1.
Figure 3:
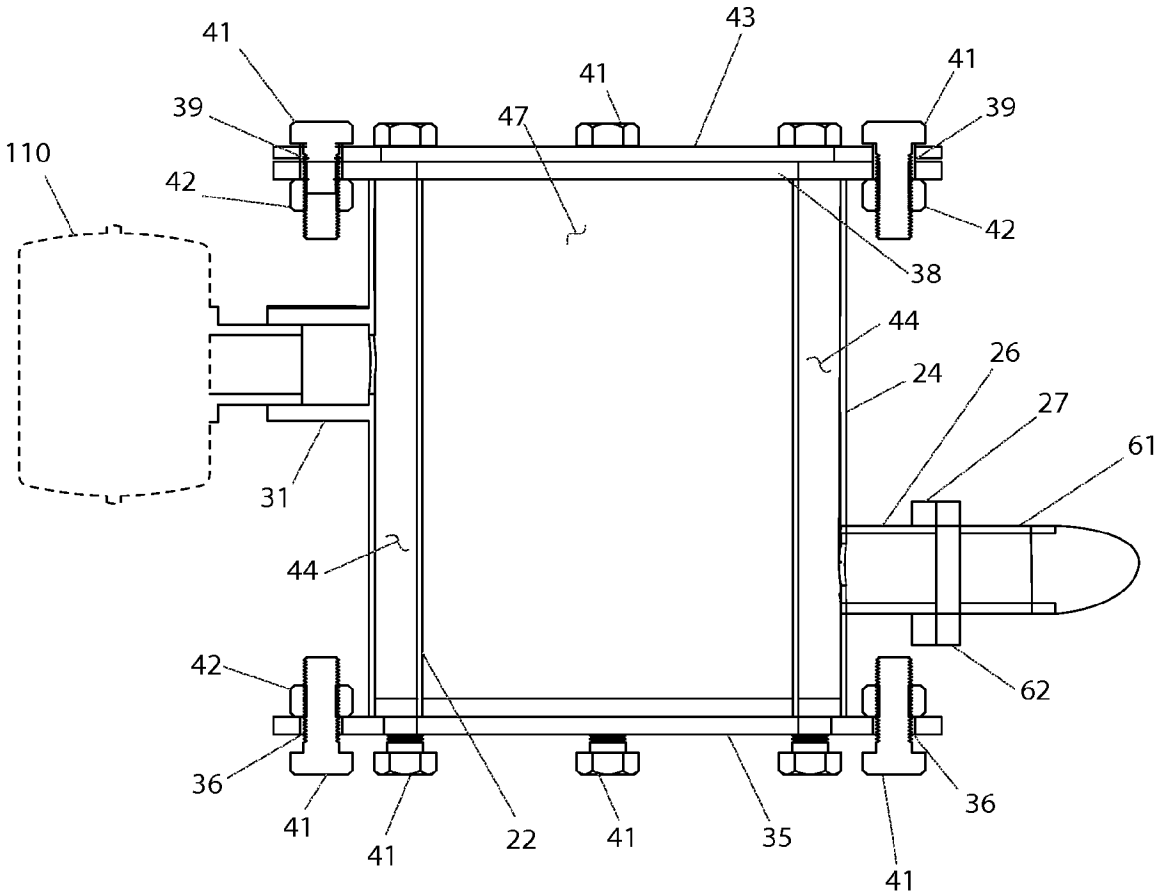
FIG. 3 is a section view, taken along section line A-A of FIG. 2, of the disclosed defrosting unit.

In accordance with the invention, the best mode is presented in terms of the described embodiments, herein depicted within FIGS. 1 through 3. However, the disclosure is not limited to the described embodiments and a person skilled in the art will appreciate that many other embodiments are possible without deviating from the basic concept of the disclosure and that any such work around will also fall under its scope. It is envisioned that other styles and configurations can be easily incorporated into the teachings of the present disclosure, and only certain configurations have been shown and described for purposes of clarity and disclosure and not by way of limitation of scope.

It can be appreciated that, although such terms as first, second, etc. may be used herein to describe various elements, these elements should not be limited by these terms. These terms are only used to distinguish one (1) element from another element. Thus, a first element discussed below could be termed a second element without departing from the scope of the present invention. In addition, as used herein, the singular forms "a", "an" and "the" are intended to include the plural forms as well, unless the context clearly indicates otherwise. It also will be understood that, as used herein, the term "comprising" or to "comprises" is open-ended, and includes one (1) or more stated elements, steps or functions without precluding one (1) or more unstated elements, steps or functions. Relative terms such as "front" or "rear" or "left" or "right" or "top" or "bottom" or "below" or "above" or "upper" or "lower" or "horizontal" or "vertical" may be used herein to describe a relationship of one (1) element, feature or region to another element, feature or region as illustrated in the figures. It should be understood that these terms are intended to encompass different orientations of the device in addition to the orientation depicted in the figures. It should also be understood that when an element is referred to as being "connected" to another element, it can be directly connected to the other element or intervening elements may be present. In contrast, when an element is referred to as being "directly connected" to another element, there are no intervening elements present. It should also be understood that the sizes and relative orientations of the illustrated elements are not shown to scale, and in some instances they have been exaggerated for purposes of explanation.

Referring to FIGS. 1-3, disclosing a defrosting unit (herein referred to as the "apparatus") 10, where like reference numerals represent similar or like parts. The apparatus 10 can be configured to be retrofitted onto a snow blower 100 (e.g., an existing snow blower or a new snow blower) to minimize the build-up of snow in the thrower outlet 102 and chute 107 of the snow blower 100 by transferring heat from the engine exhaust to a special insert fastened into a throat area of snow blower 100.

Referring now to FIGS. 1 and 2, the apparatus 10 includes a throat insert 20 and an exhaust piping assembly 50. The exhaust piping assembly 50 includes an exhaust fitting 52, with an attached exhaust fitting flange 54, and an adapter pipe assembly 60 (FIG. 2). For example, the exhaust fitting 52 can be a short pipe nipple of the equivalent size as the inlet of the muffler 110 of the snow blower 100. Disposed on a first end of the exhaust fitting 52 is an appropriate pipe thread configured to be installed (e.g., connected) to the engine 101 in place of the muffler 110. The exhaust fitting flange 54 can include a two (2) bolt steel flange used to facilitate the installation, or removal, of other components, is affixed to the second end of the exhaust fitting 52.

The adapter pipe assembly 60 is configured to transfer hot exhaust gases from the engine 101 via the exhaust fitting 52 to the throat insert 20. Those skilled in the art will appreciate that the configuration, route, orientation, and/or position of the adapter pipe assembly 60 may vary depending upon different configurations of different models of snow blower 100.

The adapter pipe assembly 60 includes a first pipe 61 with a first pipe flange 62, a flexible pipe 65, and a second pipe 67 with a second pipe flange 68. The first pipe 61 and the second pipe 67 can be made of schedule 40 steel pipe and involve any number of bends of any angle and/or straight runs of any length in order to accomplish the routing as necessary. The flexible pipe 65 can be made of a thin-walled metal tube with a plurality of folds to allow some deflection within the folds to accomplish a final alignment between flanges 27, 62, 54, and 68, or to compensate for thermal expansion, or vibration.

The first pipe flange 62 and the second pipe flange 68 are disposed on opposite ends of the adapter pipe assembly 60. The first pipe flange 62 and the second pipe flange 68 each include two (2) bolt steel flanges similar to the exhaust fitting flange 54. The first pipe 61 is in fluid communication with the inlet fitting 26 and the second pipe 67 is in fluid communication with the exhaust fitting 52. The flexible pipe 65 provides a fluid communication between the first pipe 61 and the second pipe 67.

One (1) or more heat shields 63 can be attached to any portion of the second pipe 67, and/or the first pipe 61 to protect a user from inadvertently coming into contact with the heated adapter pipe assembly 60. The heat shield 63 can include one or more standoff legs 64 to space the heat shield from the pipe 61, 67. The heat shield 63 can be made of a thin-gauge, formed metal plate.

Referring now to FIG. 3, the throat insert includes an inner wall 22, an outer wall 24, a lower flange 36, and an upper flange 38. The inner wall 22 can be a cylindrical, carbon steel tube approximately four and one-half inches (4½ in.) in diameter and seven (7) inches in length with a 10 gauge wall thickness. The outer wall 24 can be a to cylindrical, carbon steel tube approximately five inches (5 in.) in diameter and seven inches (7 in.) in length with a 10 gauge wall thickness.

The upper flange 38 and the lower flange 36 can be carbon steel annular disks with an interior diameter approximately matching the diameter of the inner wall 22 (e.g., four and one-half inches (4½ in.)) and an exterior diameter approximately matching the diameter of the thrower outlet flange 103 on the snow blower 100.

Disposed upon the lower flange 36 is a plurality of apertures matching the fastener pattern existent on the thrower outlet flange 103 of the snow blower 100. The upper flange 38 is provided with the matching pattern as this would be the case for the rotator flange 106 of the snow blower 100. A flange gasket 43 can be sandwiched between the upper flange 38 and the rotator flange 106. The flange gasket 43 can be made of a heat resistant material.

The inner wall 22 and the outer wall 24 are positioned onto the lower flange 36 with a uniform gap between the inner wall 22 and the outer wall 24 and connected (e.g., welded with a continuous bead). The upper flange 38 is positioned atop the inner wall 22 and the outer wall 24 with the upper flange apertures 39 in alignment with the lower flange apertures 36 and connected (e.g., welded with a continuous bead).

An inlet fitting 26 and a corresponding inlet flange 27 are welded onto a lower region of the exterior of the outer wall 24 in a location that would be convenient for the bolted flange connection of the exhaust piping assembly 50. The inlet fitting 26 can be made of a schedule 40 pipe fitting.

An aperture can be disposed (e.g., cut) through the outer wall 24 in line with the central passage of the inlet fitting 26 so that the hot exhaust gasses can enter the interior cavity 44 between the inner wall 22 and the outer wall 24.

The inlet flange 27 can be a two (2) bolt steel flange similar to the first to pipe flange 62. An outlet fitting 31 can be connected (e.g., welded onto an upper region of the outer wall 24 approximately opposite from the inlet fitting 26. The outlet fitting 31 can be a steel pipe union of a size corresponding to the muffler 110.

An aperture can be disposed (e.g. cut) through the outer wall 24 having the approximate outside diameter of the outlet fitting 31 and the outlet fitting 31 can be inserted into the aperture flush with the inside diameter of the outer wall 24 prior to connection (e.g., the welding procedure).

The muffler 110 can be tightened securely into the outlet fitting 31 for the exhaust gasses to escape the interior cavity 44.

Optionally, the interior passage 47 of the throat insert can be coated with a Teflon-based paint to further reduce the opportunity of snow adhesion to the interior passage 47. The exterior of the throat insert 20 can be coated with a high temperature paint to protect against corrosion.

It is envisioned that other styles and configurations of the disclosed apparatus 10 can be easily incorporated into the teachings of the present disclosure, and only certain particular embodiments have been shown and described for purposes of clarity and disclosure and not by way of limitation of scope.

In an example implementation, the user can install and utilize the example embodiments of the disclosed apparatus 10 in a simple and straightforward manner with little or no training. After initial purchase or acquisition of the system 10, 200, it can be installed and utilized as indicated in FIGS. 1 and 3.

The method of installing and utilizing the apparatus 10 may be achieved by performing the following steps: acquiring a model of the apparatus 10 having the desired configurations of the adapter pipe assembly 60, and of the upper flange 38 and the lower flange 35 of the throat insert 20; removing the muffler 110 and replacing it with the exhaust fitting 52 and the exhaust fitting flange 54; removing the rotator 105 and discharge chute 107 from the thrower outlet flange 103; installing the throat insert 20 onto the thrower outlet flange 103; reinstalling the rotator 105 and discharge chute 107 by connecting the rotator flange 106 to the upper flange 38 of the throat insert 20; connecting the adapter pipe assembly 60 between the exhaust fitting flange 54 and the inlet flange 27; and moving snow. After the initial installation of the apparatus 10 onto the snow blower 100 the user would not need to make any procedural changes from the normal routine, with the possible exception of having to stop to clear clogged snow from the chute rotator area.

The foregoing embodiments of the disclosed defrosting unit have been presented for purposes of illustration and description. They are not intended to be exhaustive or to limit the invention and method of use to the precise forms disclosed. It can be appreciated by one skilled in the art that other styles, configurations, and modifications of the invention can be incorporated into the teachings of the present disclosure upon reading the specification and that the embodiments shown and described are for the purposes of clarity and disclosure and to limit the scope. The embodiments have been chosen and described in order to best explain the principles and practical application in accordance with the invention to enable those skilled in the art to best utilize the various embodiments with expected modifications as are suited to the particular use contemplated. The present application includes such modifications and is limited only by the scope of the claims.

What is claimed is:

1. A defrost unit comprising:

a throat insert configured to be attached to a snow blower, comprising:

a tubular member having an upper end and a longitudinally opposed lower end defining an interior channel extending along a longitudinal axis;

an inner wall defining said interior channel;

an outer wall spaced away from said inner wall;

an upper flange disposed at said upper end, said upper flange being configured to be attached to a rotator flange of a chute of said snow blower; and, a lower flange disposed at said lower end, said lower flange being configured to be attached to a thrower outlet flange of said snow blower;

wherein said inner wall and said outer wall define an interior volume; and, an exhaust piping assembly interconnected between said throat insert and an engine exhaust outlet of said snow blower;

wherein exhaust gasses from said engine exhaust outlet are directed to said throat insert.

2. The defrost unit of claim 1, wherein said throat insert is attached between a thrower outlet and a chute of said snow blower.

3. The defrost unit of claim 1, wherein said exhaust piping assembly comprises:

an exhaust fitting configured to be attached to said engine exhaust outlet; and, an inlet fitting attached to said throat insert.

4. The defrost unit of claim 3, wherein said exhaust piping assembly comprises an adapter pipe assembly extending between said engine exhaust outlet and said throat insert.

5. The defrost unit of claim 4, wherein said exhaust piping assembly comprises:

a first pipe flange disposed on a first end of said adapter pipe assembly, said first pipe flange being attached to said inlet fitting; and, a second pipe flange disposed on a second end of said adapter pipe assembly, said second pipe flange being attached to said exhaust fitting.

6. The defrost unit of claim 5 wherein said inlet fitting comprises an inlet flange, said inlet flange being attached to said first pipe flange; and, wherein said exhaust fitting comprises an exhaust fitting flange, said exhaust fitting flange being attached to said second pipe flange.

7. The defrost unit of claim 6, wherein said second pipe flange is welded to said exhaust fitting flange.

8. The defrost unit of claim 6, wherein said first pipe flange is welded to said inlet flange.

9. The defrost unit of claim 6, wherein said adapter pipe assembly comprises:

a rigid first pipe section;

a rigid second pipe section; and, a flexible pipe section interconnected between said first pipe section and said second pipe section;

wherein said first pipe flange is disposed on an end of said first pipe section; and, wherein said second pipe flange is disposed on an end of said second pipe section.

10. The defrost unit of claim 1, further comprising an outlet fitting attached to said throat insert; wherein said outlet fitting is configured for attachment of a muffler.

11. The defrost unit of claim 1, wherein said throat insert comprises:

an inlet fitting in fluid communication with said interior volume, said inlet fitting being attached to said exhaust piping assembly; and, an outlet fitting in fluid communication with said interior volume, said outlet fitting being configured for attachment of a muffler.

12. The defrost unit of claim 11, wherein said exhaust piping assembly comprises:

an adapter pipe assembly extending between said engine exhaust outlet and said inlet fitting;

a first pipe flange disposed on a first end of said adapter pipe assembly, said first pipe flange being attached to said inlet fitting;

a second pipe flange disposed on a second end of said adapter pipe assembly; and, an exhaust fitting configured to be attached to said engine exhaust outlet, said second pipe flange being attached to said exhaust fitting.

13. A defrost unit comprising:

a snow blower comprising at least an engine, a thrower outlet, and a chute;

a throat insert attached to said snow blower between said thrower outlet and said chuteblower, comprising:

an upper end and a longitudinally opposed lower end;

a tubular inner wall defining an interior channel extending along a longitudinal axis;

a tubular outer wall spaced away from said inner wall, wherein said inner wall and said outer wall define an interior volume;

an inlet fitting in fluid communication with said interior volume, said inlet fitting being attached to an exhaust piping assembly, an outlet fitting in fluid communication with said interior volume, said outlet fitting being configured for attachment of a muffler;

an upper flange disposed at said upper end, said upper flange being configured to be attached to a rotator flange of said chute; and, a lower flange disposed at said lower end, said lower flange being configured to be attached to a thrower outlet flange of said thrower outlet; and, wherein said exhaust piping assembly is interconnected between said throat insert and an engine exhaust outlet of said engine;

wherein exhaust gasses from said engine exhaust outlet are directed to said throat insert.

14. The defrost unit of claim 13, wherein said exhaust piping assembly comprises:

an adapter pipe assembly extending between said engine exhaust outlet and said inlet fitting;

a first pipe flange disposed on a first end of said adapter pipe assembly, said first pipe flange being attached to said inlet fitting;

a second pipe flange disposed on a second end of said adapter pipe assembly; and, an exhaust fitting configured to be attached to said engine exhaust outlet, said second pipe flange being attached to said exhaust fitting.

* * * * *